US007637382B2

(12) United States Patent
Kraus et al.

(10) Patent No.: US 7,637,382 B2
(45) Date of Patent: Dec. 29, 2009

(54) IRREGULAR SHAPED BABY BOTTLE

(75) Inventors: Stephanie Kraus, Glendale, CA (US); Randal Ouye, La Crescenta, CA (US)

(73) Assignee: Disney Enterprises, Inc., Burbank, CA (US)

( * ) Notice: Subject to any disclaimer, the term of this patent is extended or adjusted under 35 U.S.C. 154(b) by 327 days.

(21) Appl. No.: 11/092,361

(22) Filed: Mar. 28, 2005

(65) Prior Publication Data

US 2006/0213858 A1 Sep. 28, 2006

(51) Int. Cl.
*A61J 9/00* (2006.01)
*A61J 9/08* (2006.01)

(52) U.S. Cl. ..... 215/11.1; 215/11.6; D24/197

(58) Field of Classification Search ..... 215/11.1, 215/230, 11.6; D24/197, 198; 116/307
See application file for complete search history.

(56) References Cited

U.S. PATENT DOCUMENTS

| | | | | | |
|---|---|---|---|---|---|
| D6,270 | S | * | 11/1872 | Burr | D24/197 |
| 179,416 | A | * | 7/1876 | Kennish | 215/11.1 |
| 2,024,889 | A | * | 12/1935 | Simeone | 116/311 |
| 2,150,835 | A | * | 3/1939 | Kazimirow | 215/11.6 |
| 2,387,573 | A | * | 10/1945 | Ganson | 215/11.5 |
| 2,648,226 | A | * | 8/1953 | Finch | 374/150 |
| 2,825,479 | A | * | 3/1958 | Litzie | 215/11.5 |
| 3,366,261 | A | * | 1/1968 | Dewey | 215/11.4 |
| 3,567,059 | A | * | 3/1971 | Littman | 215/11.2 |
| 3,782,577 | A | * | 1/1974 | Levey | 215/206 |
| 4,548,157 | A | * | 10/1985 | Hevoyan | 116/308 |
| 4,703,863 | A | * | 11/1987 | Kohus | 215/11.1 |
| 4,714,174 | A | | 12/1987 | Williams | |
| 4,723,673 | A | * | 2/1988 | Tartaglia et al. | 215/230 |
| 4,759,139 | A | * | 7/1988 | Ricks | 40/638 |
| 4,795,052 | A | | 1/1989 | Hayes, Jr. | |
| 4,801,027 | A | | 1/1989 | Hunter | |
| D301,741 | S | * | 6/1989 | Barber | D24/197 |
| 4,867,325 | A | * | 9/1989 | Dransfield | 215/11.2 |
| 4,915,250 | A | | 4/1990 | Hayes, Jr. | |
| 4,930,645 | A | * | 6/1990 | Warehime | 215/11.1 |
| 4,953,737 | A | | 9/1990 | Meyers | |
| 5,050,759 | A | | 9/1991 | Marble | |
| 5,082,129 | A | * | 1/1992 | Kramer | 215/221 |
| 5,150,800 | A | * | 9/1992 | Sarter et al. | 215/11.4 |
| 5,234,117 | A | * | 8/1993 | Garvin | 215/11.4 |
| 5,269,085 | A | * | 12/1993 | Chiapetta et al. | 40/311 |
| 5,294,018 | A | | 3/1994 | Boucher | |

(Continued)

*Primary Examiner*—Sue A Weaver
(74) *Attorney, Agent, or Firm*—Greenberg Traurig, LLP

(57) ABSTRACT

A container, such as a baby bottle, has an hourglass shape elongated wall substantially along its length. There is an indented portion in the hourglass shape for facilitating holding of the bottle. A rim at the top of the wall is for receiving a nipple locating closure, and the indented portion extends in height for less than half of an overall height of the bottle. The bottom of the bottle is curved and blends with wall of the bottle. The bottle has an angulated profile such that a top portion of the hourglass is arched relatively towards one side of a vertical axis extending from a bottom towards the top. The indented portion of the hourglass is angulated at a non-right angular configuration relatively to a vertical axis extending from a bottom towards the top. The inside of the bottle is formed to have a blended inside curved interface between the inside of the bottom and the inside of the wall.

9 Claims, 3 Drawing Sheets

U.S. PATENT DOCUMENTS 5,322,031 A * 6/1994 Lerner et al. ..... 116/208
D357,541 S * 4/1995 Neidell ..... D24/197
RE34,930 E * 5/1995 Kusz ..... 215/220
D371,779 S 7/1996 Nowak et al.
5,544,766 A * 8/1996 Dunn et al. ..... 215/11.1
5,553,941 A * 9/1996 Cope ..... 374/150
D376,734 S 12/1996 Petrie
D379,495 S 5/1997 Sidman et al.
D383,911 S 9/1997 Conforti et al.
5,669,665 A 9/1997 Nowak
D386,104 S 11/1997 Nowak
D386,703 S 11/1997 Nowak
D387,239 S 12/1997 Johnstone
D389,359 S 1/1998 Nowak
D390,135 S 2/1998 Rossman et al.
D391,407 S 3/1998 Rossman et al.
5,725,117 A 3/1998 Berjis
D394,166 S 5/1998 Rossman et al.
5,755,489 A 5/1998 Rossman et al.
5,761,756 A 6/1998 Nowak et al.
5,763,796 A 6/1998 Britto et al.
5,765,715 A 6/1998 Hughes
5,772,088 A 6/1998 Nelson
D395,832 S 7/1998 Rossman et al.
D396,292 S 7/1998 Nowak
D396,717 S 8/1998 Sidman et al.
D397,295 S * 8/1998 Shelton-Ferrell ..... D9/436
D400,440 S * 11/1998 Tucker ..... D9/451
5,833,189 A 11/1998 Rossman et al.
5,839,581 A * 11/1998 Vagedes ..... 206/459.1
D403,842 S 1/1999 Bair et al.
D404,493 S * 1/1999 Varlet ..... D24/197
5,871,118 A 2/1999 Franzese
5,890,620 A 4/1999 Belcastro
5,893,472 A 4/1999 Forrer
D411,349 S 6/1999 Johnstone
D412,292 S 7/1999 Nowak et al.
5,938,053 A * 8/1999 Verbovszky et al. ..... 215/6
D413,792 S 9/1999 Hotaling et al.
D417,275 S 11/1999 Conforti
5,993,285 A 11/1999 Sofia et al.
5,993,478 A 11/1999 Nowak
D417,914 S 12/1999 Nowak
6,000,750 A 12/1999 Rossman et al.
6,003,698 A * 12/1999 Morano ..... 215/11.1
D419,785 S 2/2000 Conforti et al.
D421,125 S 2/2000 Nowak
D421,126 S 2/2000 Nowak
6,026,528 A 2/2000 Pina
D421,469 S 3/2000 Reinke et al.
6,033,019 A 3/2000 Hession-Kunz et al.
6,037,872 A 3/2000 Dunnum
D422,849 S 4/2000 Knight et al.
6,045,254 A 4/2000 Inbar et al.
6,049,954 A 4/2000 Britto
D424,203 S 5/2000 Nowak
D424,312 S 5/2000 Hotaling et al.
D424,958 S 5/2000 Nowak
6,059,133 A * 5/2000 Lai ..... 215/230
D426,300 S 6/2000 Conforti
6,073,788 A * 6/2000 Stroud ..... 215/11.1
6,082,358 A * 7/2000 Scarrott et al. ..... 128/205.23
6,089,653 A 7/2000 Hotaling et al.
D430,052 S 8/2000 Nowak
D430,737 S 9/2000 Nowak et al.
D432,342 S 10/2000 Popek et al.
RE37,016 E 1/2001 Morano
D436,655 S 1/2001 Hotaling et al.
D436,800 S 1/2001 Nowak et al.
6,168,034 B1 1/2001 Perrone
6,176,042 B1 1/2001 Rossman et al.
6,202,247 B1 3/2001 Lorenz, Jr.
6,212,706 B1 4/2001 Rossman et al.
D441,872 S * 5/2001 Johansen et al. ..... D24/197
D443,233 S 6/2001 Gaudet et al.
6,253,392 B1 7/2001 Conforti et al.
6,269,968 B1 8/2001 Belcastro
6,322,149 B1 11/2001 Conforti et al.
6,325,236 B1 12/2001 Wong
6,354,708 B1 3/2002 Monahan et al.
D460,322 S 7/2002 Orr et al.
6,412,527 B1 7/2002 Brice
6,415,460 B1 7/2002 Rossman et al.
D461,361 S 8/2002 Orr et al.
D464,434 S * 10/2002 Morano ..... D24/197
D465,423 S 11/2002 Larson et al.
6,478,435 B2 11/2002 Monahan et al.
D467,125 S 12/2002 Orr et al.
6,499,254 B2 12/2002 Rossman et al.
D469,860 S 2/2003 Riemer et al.
6,513,379 B2 2/2003 Meyers et al.
6,536,163 B1 3/2003 Monahan et al.
6,536,502 B2 3/2003 Britto et al.
6,571,981 B2 6/2003 Rohlfs
6,578,209 B2 6/2003 Lopes et al.
D478,669 S 8/2003 Wear
6,640,992 B1 11/2003 Berger et al.
6,648,396 B2 11/2003 Monahan et al.
6,658,678 B2 12/2003 Hotaling et al.
6,658,681 B2 12/2003 Britto et al.
6,673,036 B1 1/2004 Britto
6,692,072 B2 2/2004 Nelson et al.
6,695,678 B1 2/2004 Foley et al.
6,722,513 B1 * 4/2004 Flood et al. ..... 215/11.1
6,749,582 B2 6/2004 Britto et al.
6,802,757 B1 10/2004 Sejnowski
6,805,072 B1 * 10/2004 DeSano ..... 116/308
D500,139 S * 12/2004 Bender ..... D24/197
6,834,400 B2 12/2004 Zanardelli et al.
6,840,918 B1 1/2005 Britto et al.
D502,551 S 3/2005 Hotaling et al.
6,910,594 B2 6/2005 Foley et al.
6,923,337 B2 8/2005 Hession et al.
6,928,674 B2 8/2005 Blackburn
6,954,955 B2 10/2005 Brewin et al.
6,964,572 B2 11/2005 Cesa
6,976,604 B2 12/2005 Connors, Jr. et al.
2003/0192468 A1 * 10/2003 Goertzen ..... 116/309
2004/0026351 A1 * 2/2004 Dunn et al. ..... 215/11.1
2005/0205512 A1 * 9/2005 Scarrott et al. ..... 215/230

* cited by examiner

FIG. 4
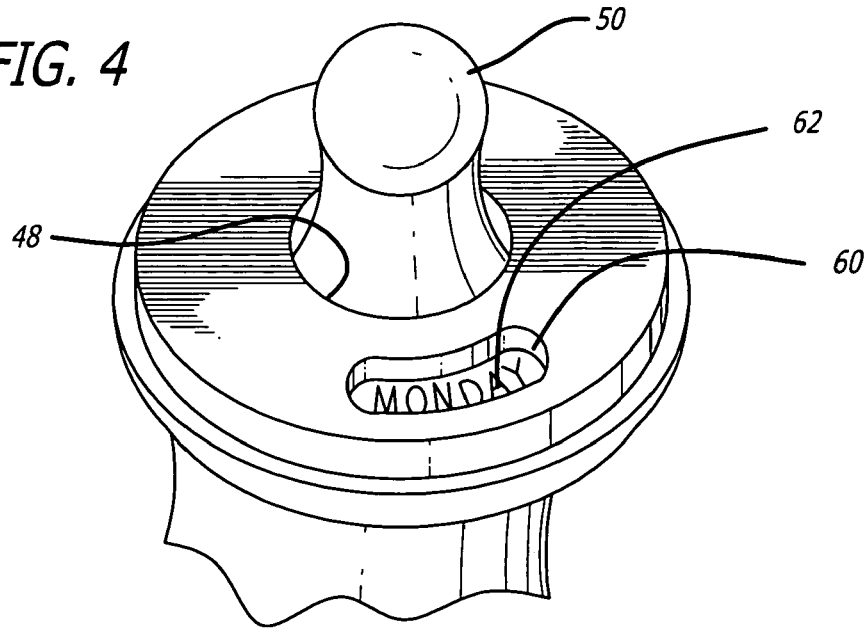
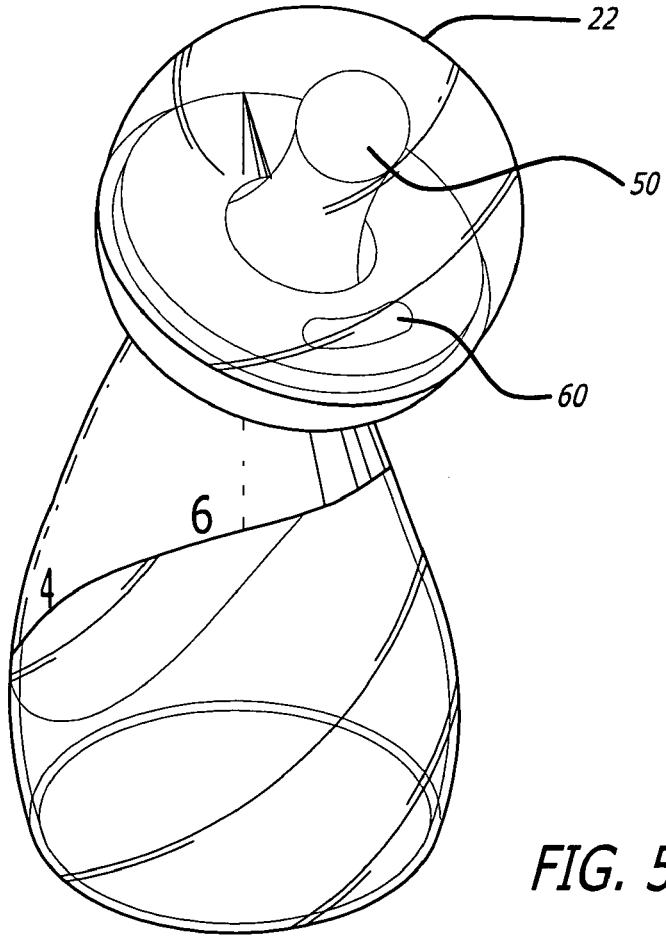
FIG. 5

IRREGULAR SHAPED BABY BOTTLE

RELATED APPLICATIONS

This application is related to U.S. Utility Patent Application filed on Mar. 28, 2005, entitled "MULTI-COMPARTMENT DISPENSING CONTAINER"; U.S. Utility Patent Application filed on Mar. 28, 2005, entitled "CLEANING UTENSIL FOR A FLUID CONTAINER"; U.S. Utility Patent Application filed on Mar. 28, 2005, entitled "A HANDLED DRINKING CONTAINER"; and U.S. Utility Patent Application filed on Mar. 28, 2005, entitled "BABY BOTTLE WITH ENLARGED LOWER PORTION"; all of which have been filed concurrently herewith. The contents of those applications are incorporated by reference herein.

BACKGROUND

1. Field

This disclosure relates to baby bottle constructions. More particularly the disclosure relates to an ergonomically designed baby bottle.

2. General Background

There are numerous baby bottles on the market, with different functions and features. None of the known bottles provide the features of the present disclosure. The prior art is replete with varying baby bottle sizes and constructions. However, none of the bottles appear to address needs that arise to collectively facilitate balance, handling, and ease of feeding infants.

While the prior art constructions may be adequate for the basic purpose and function for which they have been designed, they fail to provide a simple, efficient, and practical feeding bottle. In particular, the prior art fails to disclose a bottle sized and constructed to enhance an infant's grasp of the bottle and comfort while gripping the bottle, increase control during the feeding process, and permit correct upstanding balance when not in use.

There is a need for an improved ergonomically designed baby bottle construction that simplifies feeding, and the support functions associated with this, and permits easy and convenient bottle support when not in use.

It is an object of the present disclosure to provide a baby bottle to facilitate drinking, whether the baby is in a reclining or sitting position, and to adapt for the baby as the baby develops, and at the same time making feeding an easier function for the feeding person.

SUMMARY

A container such as a baby bottle has an irregular shape. In one form this is an hourglass shape elongated curved side wall substantially along its length. The curved wall extends upwardly generally in a convex manner from the bottom in an upwards direction. There is an indented portion in the hourglass shape for facilitating holding of the bottle. A rim at the top of the wall is for receiving a mouthpiece locating closure. The indented portion extends in height for less than half of an overall height of the bottle.

The indented portion is relatively closer towards the top of the bottle than the bottom of the bottle. The indented portion extends circumferentially in a circle about the wall. As such, the indented portion extends circumferentially about the wall in a relatively transverse sense. The indented portion of the hourglass is angulated at a non-right angular configuration relatively to a vertical axis extending from a bottom towards the top.

In one form, the bottom of the bottle is curved and blends with the side wall of the bottle. The side wall is formed by at least two portions. One portion of the wall is essentially transparent and the other portion of the wall is essentially opaque. The bottom is the essentially opaque portion.

The bottle has an angulated profile such that a top portion of the hourglass is arched relatively towards one side of a vertical axis and extends from a bottom towards the top.

The bottle has an angulated profile such that a top portion of the wall is arched relatively towards one side of a vertical axis extending from a bottom towards the top.

A base portion is provided for location with a bottom of the bottle, and the base supports the bottle in a relatively upright manner. There is a cover, and a mouthpiece locating closure. The cover is removable. The cover is curved and blends with the closure and the wall of the bottle. The mouthpiece is for a nipple, or can be for a relatively solid spout for a sipper cup.

The inside of the bottle is formed to have a blended inside curved interface between the inside of the bottom and the inside of the wall. The curved inside interface is such that there is a relatively continuous smooth curve between the wall, the interface and the bottom portions.

DRAWINGS

The above-mentioned features and objects of the present disclosure will become more apparent with reference to the following description taken in conjunction with the accompanying drawings, wherein like reference numerals denote like elements, and in which:

FIG. 4 is a top perspective view of the nipple securing portion of a baby bottle in accordance with the disclosure.

FIG. 5 is a top perspective view of a baby bottle in accordance with an alternate embodiment of the disclosure, and where there is no base.

DETAILED DESCRIPTION

Figure 1:
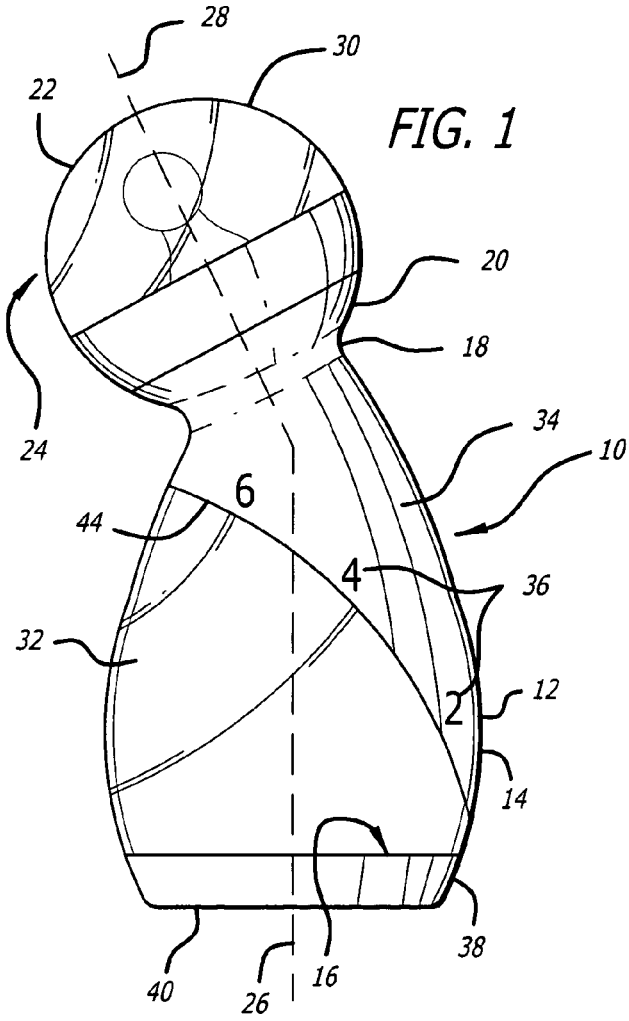
FIG. 1 is a side view of a baby bottle in accordance with the disclosure.
Figure 2:
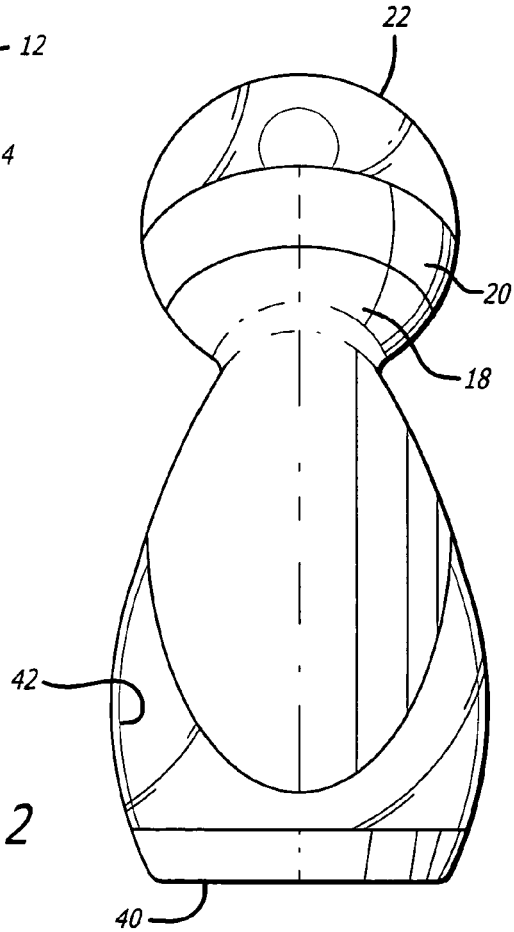
FIG. 2 is a back view of a baby bottle in accordance with the disclosure.

The device is now described with reference to an example which is not to be considered as limiting. This is purely an illustration of the device.

One of ordinary skill in the art will understand that the present discussion is a description of exemplary embodiments only, and is not intended as limiting the broader aspects of the present disclosure, which broader aspects are embodied in the exemplary construction. A repeat use of reference characters in the present specification and drawings represents the same or analogous features or elements of the disclosure.

A baby bottle has an hourglass shape elongated wall substantially along its length. There is an indented portion in the hourglass shape for facilitating holding of the bottle. A rim at the top of the wall receives a nipple locating closure, and the indented portion extends in height for less than half of an overall height of the bottle. The indented portion is relatively closer towards the top of the bottle than the bottom of the bottle. The indented portion extends circumferentially in a circle about the wall. As such, the indented portion extends circumferentially about the wall in a relatively transverse sense. The bottom of the bottle is relatively curved and blends with the wall of the bottle. This curvature can be on the inside and/or outside of the wall and the bottom.

The wall is formed by at least two portions. One portion is essentially transparent, and the other portion is essentially opaque. The bottom wall portion is at least essentially transparent, and the portion above the bottom is essentially opaque. A line of distinction between the two portions is at an angle extending radially upwards from a location near the bottom. The line ends at a location towards the relatively lower position of the indentation.

The bottle has an angulated profile such that a top portion of the hourglass is arched relatively towards one side of a vertical axis extending from a bottom towards the top. The bottle has an angulated profile such that a top portion of the wall is arched relatively towards one side of a vertical axis extending from a bottom towards the top.

The nipple locating closure has a central area with an aperture for receiving a removable nipple. There is also a peripheral zone with a portion for a window or indicator zone when the closure is located on the top of the bottle.

The baby bottle has an elongated wall with a top of the wall for receiving a nipple locating closure. The inside of the bottle is formed to have a blended inside curved interface between the inside of the bottom of the wall and the inside of the side wall. The curved inside interface provides a relatively continuous smooth curve between the wall, the interface and the bottom portion. In one form, the outside of the bottom of the bottle is curved and blends with the curves of the wall of the bottle.

In the drawings there is shown generally a baby bottle 10 which has an hourglass shape. There is the bottom portion 12 which has a broad diameter 14 and flat base 16. There is a waist or indented section 18 at a fairly high place above the base relative to the overall size of the bottle. There is an expanded section 20 above the waist 18.

The expanded section 20 merges with a curved cover 22 to form a ball-like appearance effect for the top portion of the hourglass shaped bottle 10. The top ball-like portion generally indicated by numeral 24 is angularly arched over relative to the vertical axis 26 running through the central part of the lower portion 14 of the bottle. There is a central axis 28 running through the ball-like section 24, and the axis 28 and axis 26 intersect approximately midway or above midway in the overall height of the bottle as measured when the cover is in place. The height is determined from the base 16 to the top portion 30 of the ball-shape 24.

The bottom portion 14 includes a solid type area 32 which is substantially transparent and a solid type area 34 which is substantially opaque. There are also indicia 36 which are located on the opaque portion 34 for indicating the amount of fluid in the body portion of the bottle.

The base 16 of the bottle fits into a base element 38 so that there is a secure location with a flat portion 40 for the base 38. The base 38 also provides for stability of the bottle 10 when needed to be located in a relatively upright position.

The interface line 44 between the transparent portion 32 and opaque portion 34 runs essentially diagonally from a location towards the base to a location near the indentation or waist 18. The inside surface 42 is relatively curved between the inside of the wall 12 and inside of the bottom 16. In this manner, cleaning and handling of the inside of the bottle can be conveniently achieved.

The nipple or mouthpiece holding portion 46 is arranged with an aperture 48 through which a nipple 50 or other mouthpiece can be located. The element 46 sits on the neck 52 on top of the bottle. The element 46 can screw connect with the neck or otherwise clip in position on top of the neck. The top of the portion 46 has a lip or a ridge 53 for securing the rim 54 of the cover 22.

Figure 3:
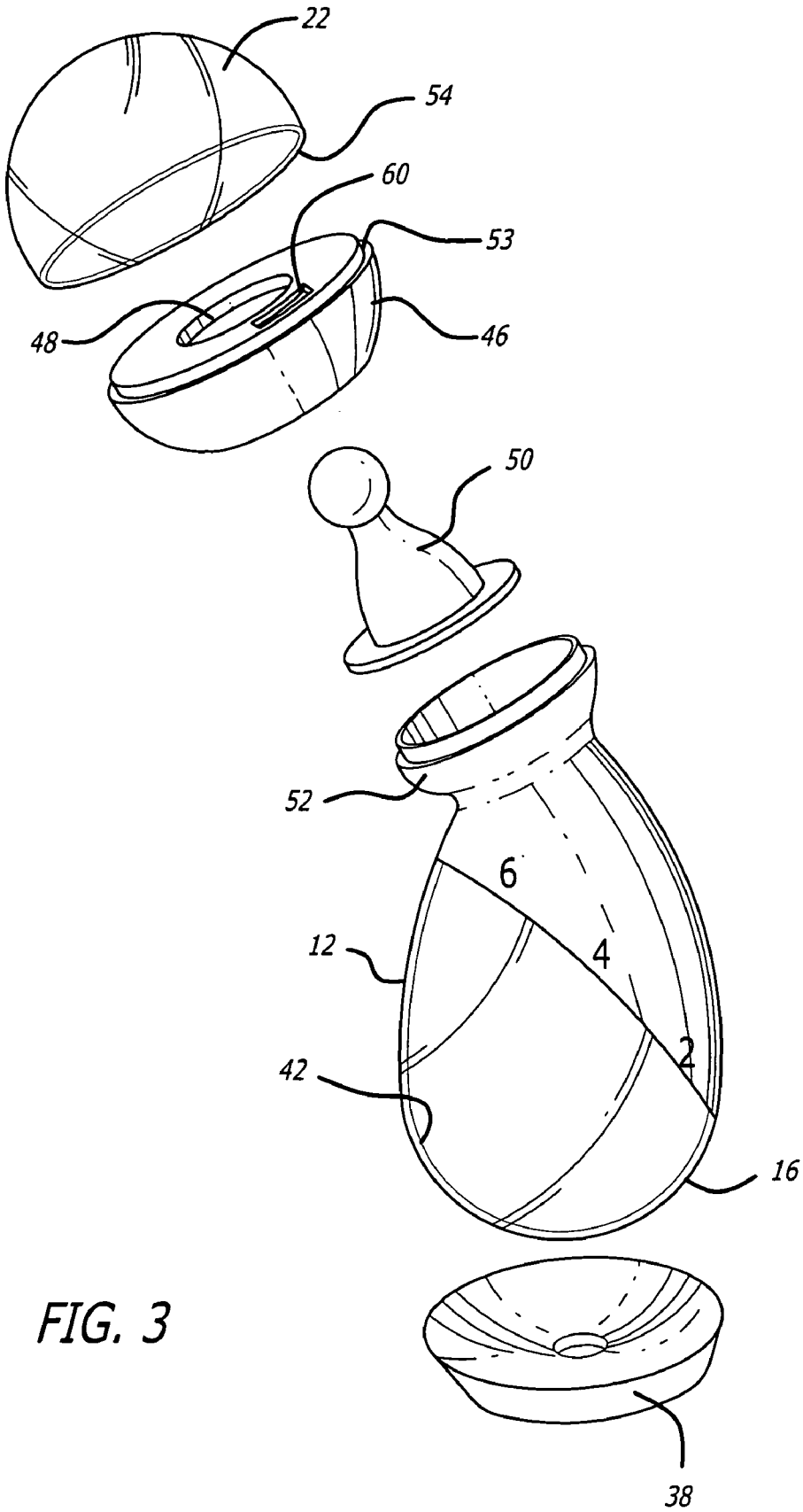
FIG. 3 is an exploded perspective view of a baby bottle in accordance with the disclosure.

In some different embodiments of the disclosure, the base 16 for the bottle 10 can be flat and not curved as illustrated in FIG. 3. In such cases, a base element 38 may or may not be used for the bottle.

In other forms of the disclosure, instead of a smooth curved arcuate arching of the bottle, a different angulation can be formed. In yet other forms of the disclosure, there may be no angulation and the bottle can be relatively straight.

With the bottle of the disclosure, there is provided an ergonomic baby bottle with physical measurements being possible in relatively low light. The indicia that are on the bottle are formed with high contrast measurement graphics so as to facilitate reading of the bottle size. In this sense, the indicia can be formed as cut-outs in the opaque section 34. The opaque section itself can be a layer of material placed on the transparent portion of the bottle. As such, this opaque layer can be a non-slip translucent elastomer with an overmold grip.

In the mouthpiece securing portion, there is a window or cut-out 60 through which information such as the day or date 62 can be shown in the ring being part of the mouthpiece securing portion. This ring or cap for securing the mouthpiece can locate standard nipples and nipple rings. The size of the bottle can vary as required.

An advantage of the angulation is that the bottle shape can match the sucking needs of the baby in that the flow and angle are better matched. This can effectively reduce air bubbles to the baby and thereby facilitate comfort to the baby. The opaque layer can be an overlay of different material, or a transparent material. Alternatively, there are other forms of having the opaque portion and transparent portions of the bottle or cup formed in an integrated leak-proof manner. The indicia could be formed of a material or paint with glow-in-the-dark characteristics so as to facilitate use under dim light conditions.

In some cases, instead of a curved inside, the base can be relatively flat. The bottles can be of different sizes, for instance, 5, 6 or 8 ounces.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A baby bottle, comprising:

a bottom portion, the bottom portion having a base and a curved sidewall about a central axis, the curved sidewall having an indented portion forming a curved shape to the bottom portion; and a top portion having a ball-like appearance concentric about an axis extending at an angle from the central axis of the bottom portion, the top portion comprising:

a neck diverging from the indented portion of the bottom portion;

a mouthpiece locating closure joining the neck;

a mouthpiece having a ring shaped rim portion disposed between the closure and the neck; and a curved cover over the mouthpiece and removably fastened to the mouthpiece locating closure, wherein together the neck, the mouthpiece locating closure and the cover give the ball-like appearance to the top portion.

2. The baby bottle of claim 1, wherein the indented portion extends in height for less than half of the overall height of the baby bottle.

3. The baby bottle of claim 1, wherein the indented portion is relatively closer towards the top than the base of the baby bottle.

4. The baby bottle of claim 1, wherein the base of the baby bottle is curved and blends with the curved side wall of the baby bottle.

5. The baby bottle of claim 1, wherein the curved side wall has at least two portions, one portion being essentially transparent and the other portion being essentially opaque.

6. The baby bottle of claim 5, further comprising a line of distinction between the two side wall portions, the line of distinction being at an angle extending from a location towards the base of the baby bottle to a position towards the indented portion.

7. The baby bottle of claim 1, wherein the mouthpiece locating closure has a window through which a portion of the rim portion is visible.

8. The baby bottle of claim 1, wherein the base of the baby bottle being curved and blending with the curved side wall of the baby bottle, the curvature being such that the baby bottle is incapable of standing upright without external support.

9. The baby bottle of claim 8, further comprising a support base element for receiving the base of the bottom portion of the baby bottle, the support base supporting the baby bottle in a relatively upright manner.

* * * * *

UNITED STATES PATENT AND TRADEMARK OFFICE

CERTIFICATE OF CORRECTION

PATENT NO. : 7,637,382 B2
APPLICATION NO. : 11/092361
DATED : December 29, 2009
INVENTOR(S) : Kraus et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 448 days.

Signed and Sealed this

Ninth Day of November, 2010

David J. Kappos

David J. Kappos
*Director of the United States Patent and Trademark Office*